US012521615B2

(12) United States Patent
Carr

(10) Patent No.: US 12,521,615 B2
(45) Date of Patent: Jan. 13, 2026

(54) TRAINING DEVICE FOR STICK-BASED SPORTS

(71) Applicant: Darron Carr, Morris, MN (US)

(72) Inventor: Darron Carr, Morris, MN (US)

(73) Assignee: Filthy Fives, LLC

( * ) Notice: Subject to any disclaimer, the term of this patent is extended or adjusted under 35 U.S.C. 154(b) by 930 days.

(21) Appl. No.: 17/732,702

(22) Filed: Apr. 29, 2022

(65) Prior Publication Data

US 2022/0347538 A1 Nov. 3, 2022

Related U.S. Application Data

(60) Provisional application No. 63/181,593, filed on Apr. 29, 2021.

(51) Int. Cl.
*A63B 69/00* (2006.01)

(52) U.S. Cl.
CPC ..... *A63B 69/0026* (2013.01); *A63B 2214/00* (2020.08)

(58) Field of Classification Search
CPC . A63B 69/0024; A63B 69/0026; A63B 60/14; A63B 2214/00
See application file for complete search history.

(56) References Cited

U.S. PATENT DOCUMENTS 8,128,542 B2 * 3/2012 Hartman ..... A63B 60/30 482/122
8,602,925 B1 * 12/2013 Rickon, Jr. ..... A63B 60/14 473/568
12,070,668 B1 * 8/2024 Vaughn ..... A63B 69/0059
2010/0173751 A1 * 7/2010 Siipola ..... A63B 60/06 473/422
2012/0295744 A1 * 11/2012 Taylor ..... A63B 60/20 473/513
2014/0057734 A1 * 2/2014 Lu ..... A63B 53/14 473/298
2014/0343214 A1 * 11/2014 Marcus ..... C09J 11/04 524/451
2014/0357432 A1 * 12/2014 Pfeifer ..... A63B 60/00 473/513
2018/0057647 A1 * 3/2018 Nasco ..... C08J 5/18
2018/0272207 A1 * 9/2018 Clarke ..... A63B 69/0026
2021/0154542 A1 * 5/2021 Sliepka ..... A63B 53/14
2021/0154546 A1 * 5/2021 Sliepka ..... A63B 60/08
(Continued)

FOREIGN PATENT DOCUMENTS

WO WO-2010078546 A1 * 7/2010 ..... A63B 49/035
WO WO-2019237153 A1 * 12/2019
(Continued)

*Primary Examiner* — Raleigh W Chiu
(74) *Attorney, Agent, or Firm* — Gutwein Law; Tyler B. Droste

(57) ABSTRACT

An adjustable flexible device for use in training activities for stick-based sports. The device is comprised of a flexible material provided in a planar surface in a flattened and free state. The device includes a first end, a second end opposite the first end, and a slot located through the material and configured to securely receive the first end. In use, the device is wrapped into a cylindrical shape around the stick and secured in place via the slot and first end coupling. The device material properties provide that it is collapsible.

19 Claims, 10 Drawing Sheets

(56) References Cited

U.S. PATENT DOCUMENTS

| | | | | |
|---|---|---|---|---|
| 2022/0111273 | A1* | 4/2022 | Aiello | A63B 60/14 |
| 2022/0347538 | A1* | 11/2022 | Carr | A63B 69/0026 |
| 2024/0299797 | A1* | 9/2024 | Cowhey, III | A63B 21/028 |

FOREIGN PATENT DOCUMENTS

| | | | | |
|---|---|---|---|---|
| WO | WO-2022253431 | A1 * | 12/2022 | A01K 87/08 |
| WO | WO-2024177843 | A1 * | 8/2024 | |

* cited by examiner

TRAINING DEVICE FOR STICK-BASED SPORTS

CROSS-REFERENCE TO RELATED APPLICATION

This U.S. patent application claims priority to U.S. Provisional Application 63/181,593 filed Apr. 29, 2021, to the above-named inventor, the disclosure of which is considered part of the disclosure of this application and is hereby incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to a new and improved apparatus in the form of a device to aid in training for stick-based sporting activities. In one aspect, the apparatus of the present disclosure is configured for attachment to a stick, such as a hockey stick, to aid in stick handling drills while allowing the stick to still be utilized in activities requiring the stick to be secured, such as, but not limited to, shooting drills.

BACKGROUND

Within traditional sports utilizing a stick, such as, but not limited to, hockey and lacrosse, a loose grip on one hand of the stick is required to allow for rotational movement of the stick during use. Particularly within the sport of ice hockey a loose bottom hand is necessary to allow the top hand to rotate the stick for manipulating the puck in sudden and quick changes of direction commonly referred to as "stick handling" within the art.

Within the prior art, to illustrate the exemplary feel of a loose hand, it is recommended to place a rigid tubular item, such as a cardboard toilet paper roll, around the shaft of the stick to better enable this rotation. While this type of tubular structure is useful in emphasizing the need for a loose bottom hand during stick handling drills, the rigid structure does not allow for additional use of the device for other drills, such as shooting drills, while the device is placed on the stick.

Additionally, this rigid tubular structure, which has a fixed diameter, may not be able to be used on all sticks as often the grip portion of the stick may include additional materials, such as, grip tape or a knob, which increases the diameter of the stick preventing easy receipt of the tubular structure over the grip end.

Therefore, a need exists for an improved training device that is configured for universal use and placement on a stick of varying diameters. Still further, there exists a need for a stick handling and training device that is selectively operable between a loose position to enable rotation of the stick and a fixed position to prevent rotation of the stick during use.

Preferably, this device is provided in an assembly that is robust, durable, universal, and easy to use.

BRIEF SUMMARY OF THE INVENTION

In one aspect, this disclosure is related to stick handling training device that is movable between a loose position and a fixed position. The device is flexible, thin, compressible and capable of being coiled.

In another aspect, this disclosure is related to a training tool for stick sports that is provided in an assembly that is configured for universal use on several diameters and types of sticks.

In yet another aspect, this disclosure is related to a flexible and sided assembly configured for wrapping around the shaft of a stick for aiding in the simulation of a loose hand during stick handling activities.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
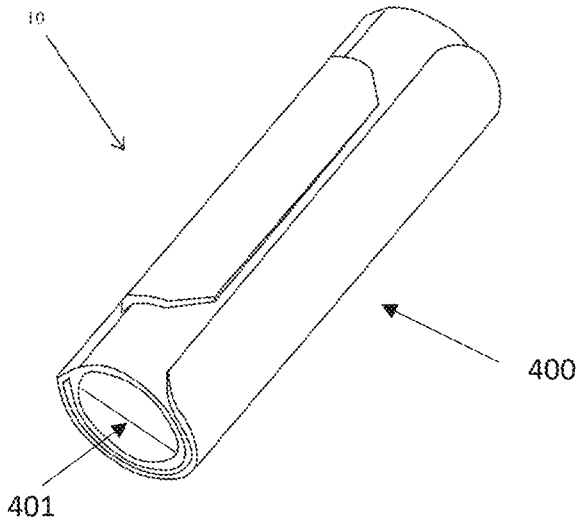
FIG. 1 is an isometric view of the training device in a wrapped position, according to the present disclosure.
Figure 2:
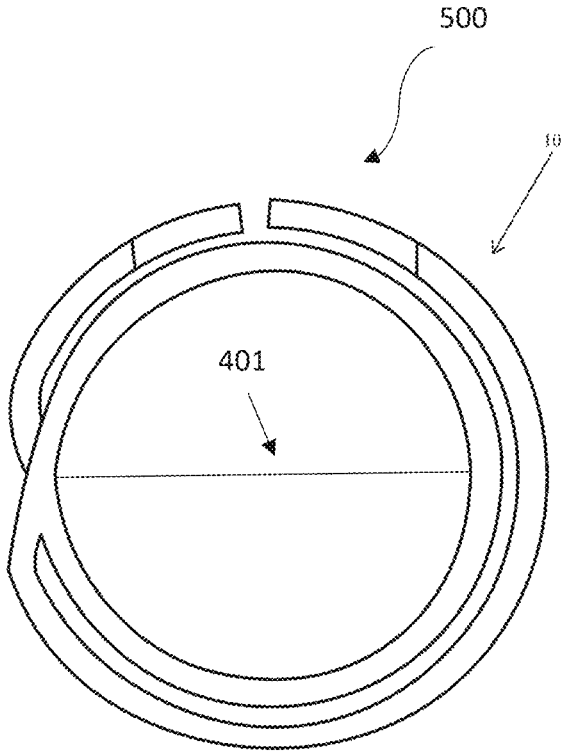
FIG. 2 is an end view of the training device in the wrapped position, according to the present disclosure.
Figure 3:
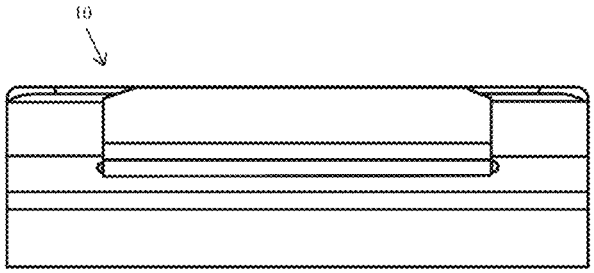
FIG. 3 is a side view of the device in the wrapped position, according to the present disclosure.
Figure 4:
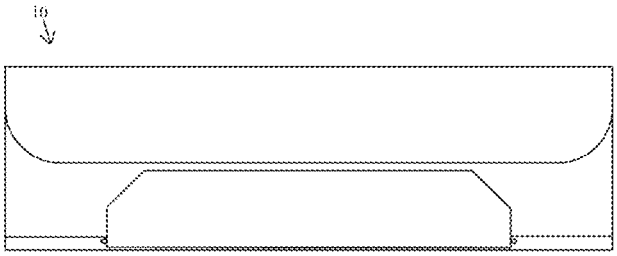
FIG. 4 is an alternate side view of the device, according to the present disclosure.
Figure 5:
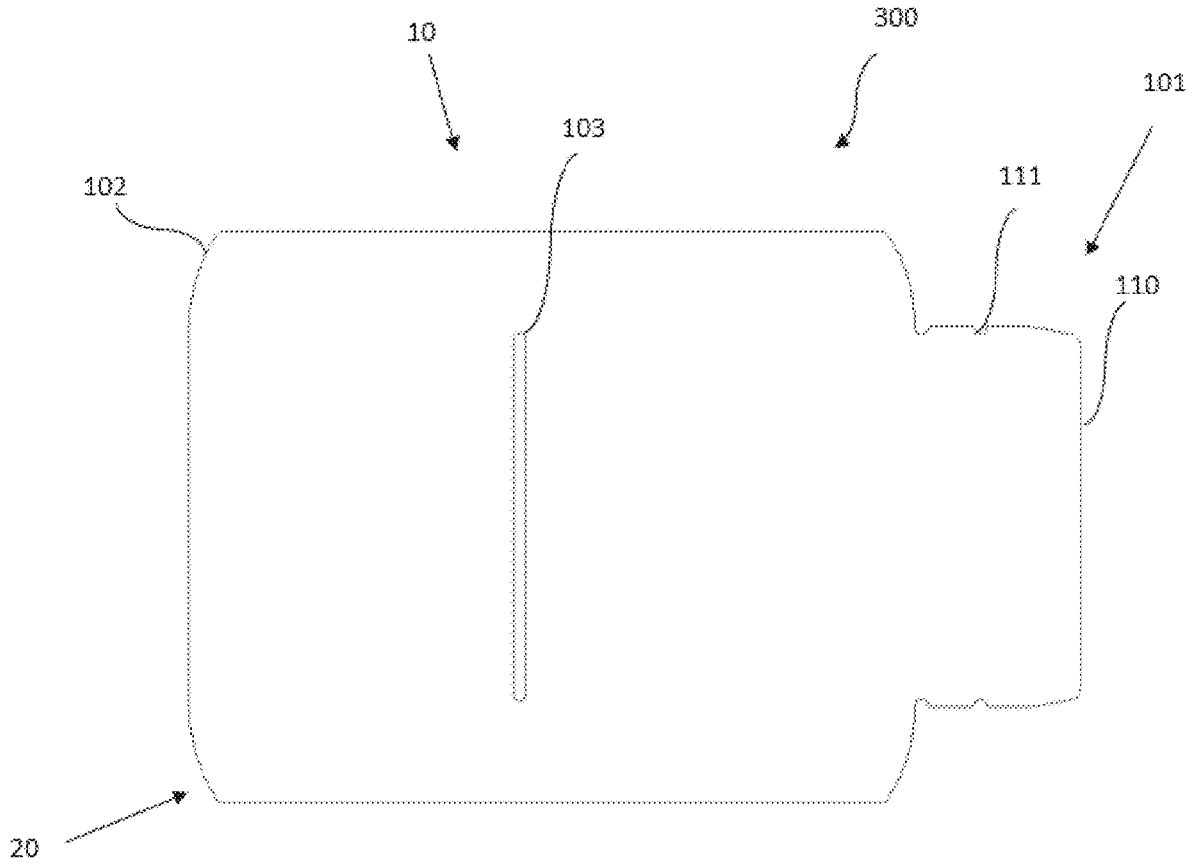
FIG. 5 is a top view of the training device in a flattened position, according to the present disclosure.
Figure 6:
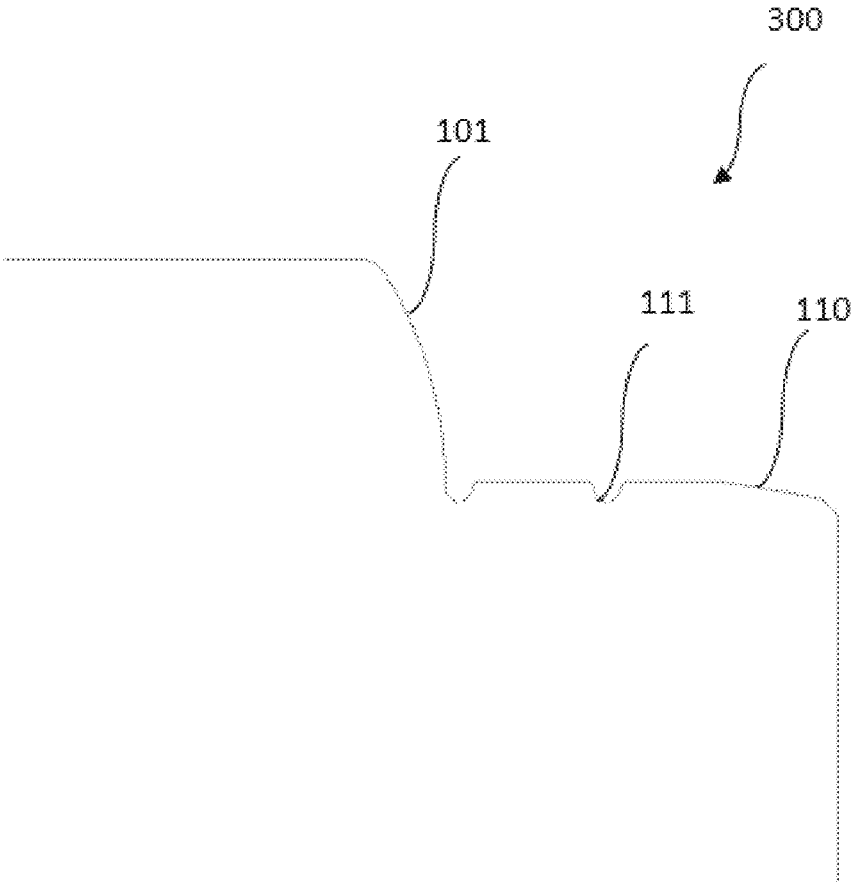
FIG. 6 is an exploded view of a first end of the device, according to the present disclosure.
Figure 7:
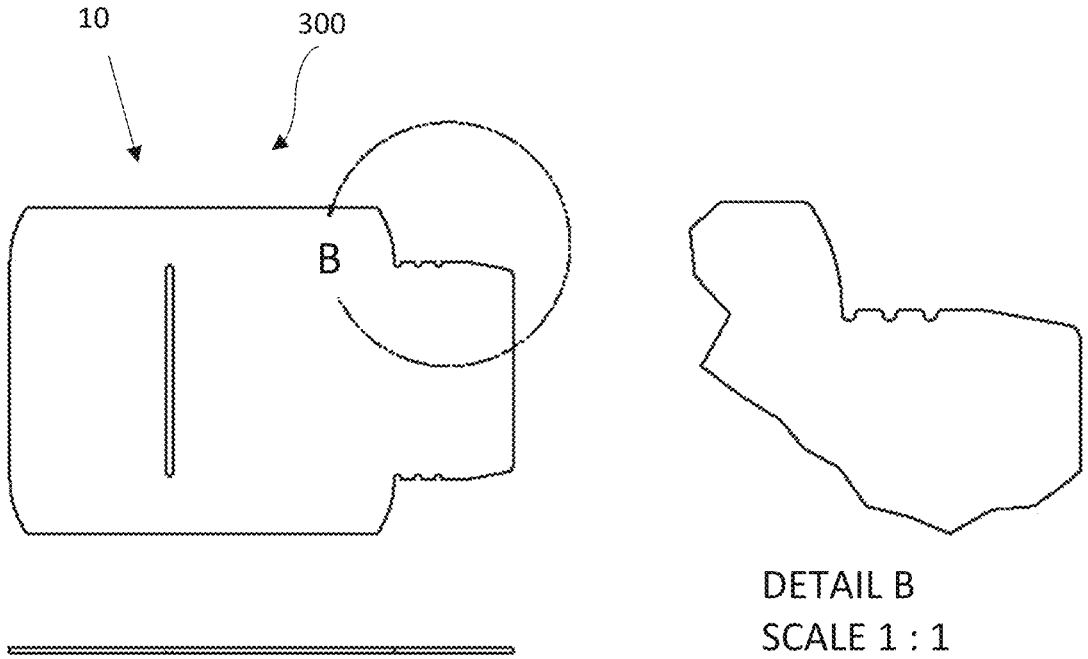
FIG. 7 is several views of the device including a top side view, a detailed view of the first end, and a side view in the flattened position, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit, or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

Referring now to the figures, FIG. 1 to FIG. 11 of a training device for stick-based sports and capable of selective receipt around a shaft of a stick utilized in these stick-based sports and generally referred to herein as device 10. Most generally the device 10 is configured to have recovery properties, wherein the device 10 is selectively operable between a loosened position 100 to enable rotation of the stick and a fixed position 200 wherein the device 10 is compressed to prevent rotation of the stick during use. The movement of the device 10 between the loosened position 100 and fixed/compressed position 200 is configured to simulate and aid in an understanding of the grip pressure of at least one hand needed to execute certain movements and uses of the stick during these sporting activities. The device 10 is configured to be movable from a first position indicated as the loosened position 100 to a second position indicated as the fixed position 200 when a squeezing force is applied onto the device 10, wherein the device 10 shape generally compresses within the hand and around the shaft. The device 10 is configured to return from the second position 200 to the first position 100 when the application of force (i.e., grip pressure) onto the device 10 is relaxed. Preferably, the device 10 is comprised of a resilient or flexible material that has properties rendering it flexible, thin, compressible, and capable of being coiled.

Accordingly, the device 10 resilient and flexible material 20 is selected to have recovery properties, wherein the flexible material 20 is capable of being movable from the first position 100 to the second position 200 when force is applied onto the flexible material while it is placed onto the stick during use. The flexible material 20 resilient properties enable the device 10 to be capable of recovering from the second position 200 to the first position 100 on its own after the application of force to the flexible material of the device 10 is relaxed. Preferably, the flexible material 20 is thin, compressible, and capable of being coiled. The flexible material 20 can be any material having a durometer as measured on the Shore A hardness scale between 50 and 90 (Shore A 50-90) that renders the material capable of being coiled. The flexible material 20 preferred thickness has a maximum dimension of 0.125 inch (0.125") with the preferred thickness being 0.06 inch (0.06") thick with a hardness of 90 on the Shore A scale.

The flexible material 20 of the device 10 can be any resilient material capable of recovery, including, but not limited to, rubber, silicone, thermoplastic elastomers (TPE), or leather. The flexible material 20 can be selected based upon a particular sport or strength level of the user, such as providing one type of material for adult use and another type of material for use by youths. In a preferred embodiment of the present disclosure, the flexible material 20 of the device 10 is provided in a sided assembly wherein a side of the device generally contacting the stick includes a coating 320 in the form of a material to reduce friction during use. Preferably, this coating is a polymer coating such as, but not limited to, a polytetrafluoroethylene ("PTFE") type or nano-ceramic coating to create a strong high-release and non-stick surface. Although this type of coating is preferred, other similar slick coatings or materials may be used, such as, but not limited to talc, corn starch, PTFE derivatives, nano surface treatments, or other similar materials and coatings to reduce a coefficient of friction of at least one side of the device 10.

The device 10 is generally movable between a flattened and planar surface 300 (FIG. 5, FIG. 6 and FIG. 7) and wrapped state (100, 200) when in use. Accordingly, the device 10 is generally provided in the flattened and planar surface 300, then the device 10 is affixed to a given stick when desired for use by wrapping the device 10 around a shaft of the stick in a cylindrical shape 400 and securing the device 10 upon itself in a desired position (100, 200) through a fastening mechanism 500. The cylindrical shape 400 has an adjustable internal diameter 401 to accommodate a desired diameter of the shaft of the stick the device 10 is utilized upon.

Figure 8:
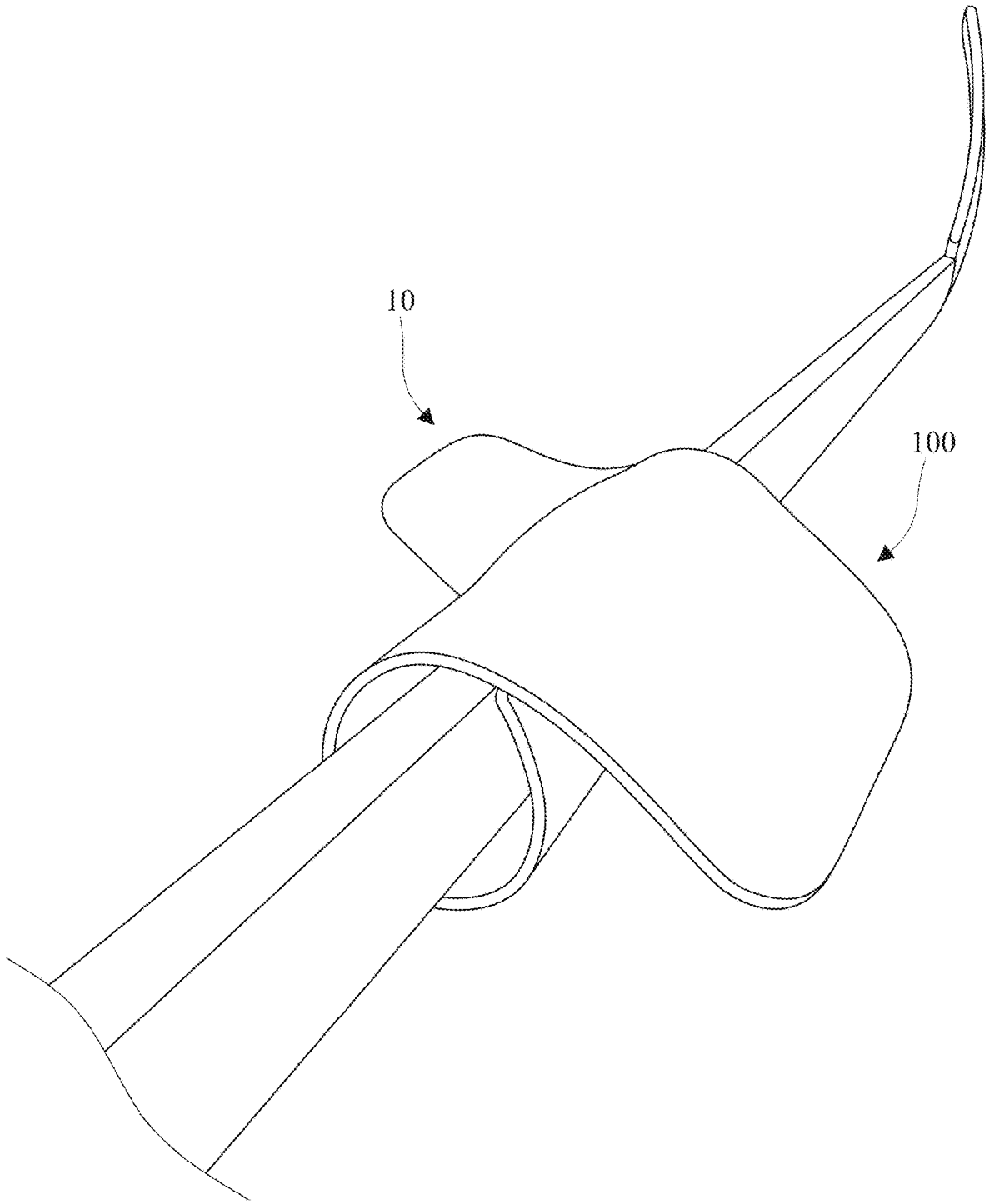
FIG. 8 is a view of the device positioned on a hockey stick, according to the present disclosure.
Figure 9:
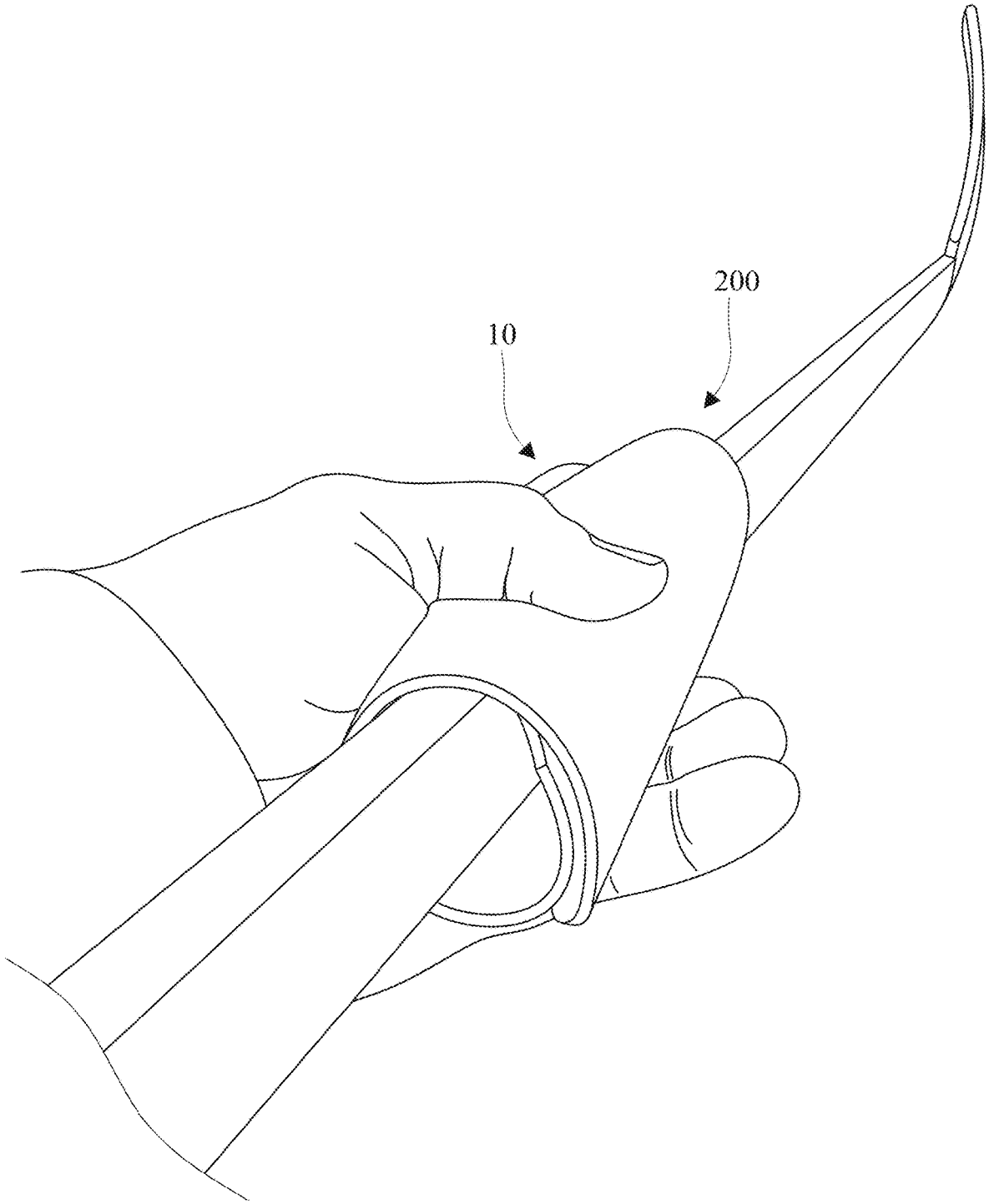
FIG. 9 is a view of the device during use on a hockey stick, according to the present disclosure.

The device 10 method of use generally comprises the device 10 being applied to the shaft in a loosened position 100 (FIG. 8). The loosened position 100 allows for drills requiring axial rotation of the stick where the device 10 is loosely gripped by a user and when desired the device 10 can be compressed against itself and the shaft of the stick to the compressed/fixed position 200 to prevent axial rotation of the stick for drills (FIG. 9), such as shooting and passing, when rotation of the stick is not desired. The flexible material 20 allows for the device 10 to be compressed from the loosened position 100 to the fixed/compressed position 200 (FIG. 8 to FIG. 9), and to return to the loosened position 100 when the application of force is relaxed.

In a top view of the device 10 the features and shape of the stick handling training device can better be seen and described. The device 10 is generally constructed from the flattened and planar surface 300 comprised of the flexible material 20. The device 10 having a first end 101 opposite a second end 102, with the distance between the first end 101 and the second end 102 defining a length of the device 10. The first end 101 generally forming a tab 110 with a plurality of notched grooves 111. The tab 110 and notched grooves 111 are configured with a size and shape to both conform for receipt within a slot 103 and retain the tab 110 within the slot 103 when desired. The tab 110, notched grooves 111, and slot 103 selected and positioned to accommodate a variety of diameters of shaft sizes of sticks the device 10 is wrapped around.

The slot 103 extends through an entirety of the material and is generally positioned between the first end 101 and the second end 102. As the position of the slot 103 distance from the first end 101 and tab 110 will determine the internal diameter 401 of the cylindrical shape 400 when device 10 is wrapped, the slot 103 can be positioned at a preselected distance to accommodate a desired diameter of the shaft of the stick the device 10 is utilized upon.

As it will be appreciated, the device 10 is provided in a flexible assembly that is configured for universal use on several diameters and types of sticks. The flexible assembly configured for wrapping around the shaft of a stick for aiding in the simulation of a loose hand during stick handling activities.

In use, the device 10 is wrapped into a cylindrical shape 400 via a fastening mechanism 500. The cylindrical shape 400 having the adjustable internal diameter 401 that allows the device 10 to be utilized in several stick sizes. In the preferred embodiment, the tab 110 is inserted into the slot 103 and the plurality of notched grooves 111 retain the device 10 in the cylindrical shape 400. This allows the device 10 to be installed around a stick regardless of knob or grip configuration and does not require a user of the device 10 to axially install from one end of the stick. The flexible material 20 of the device 10 and the selected and preferred material hardness properties render the device 10 capable of being coiled to form a cylinder within which the stick can axially move freely when not gripped by the user.

Figure 10:
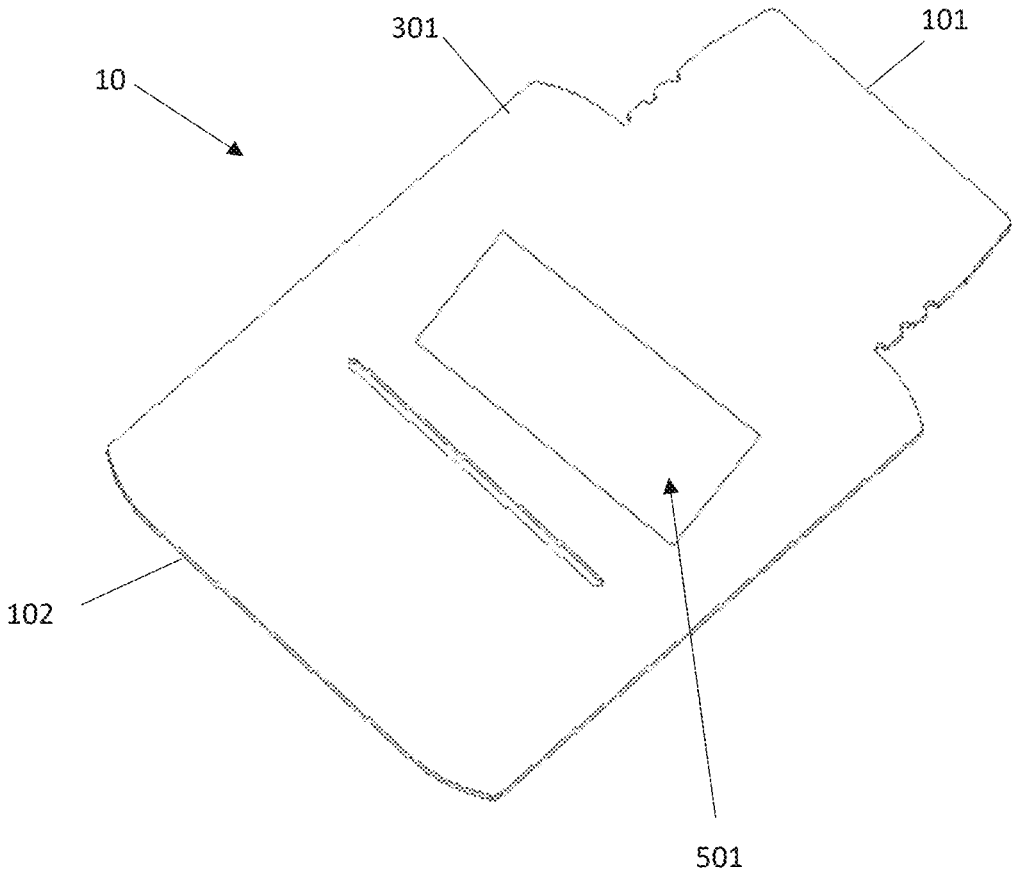
FIG. 10 is a view of the device first side including the alternate fastening system, according to the present disclosure.
Figure 11:
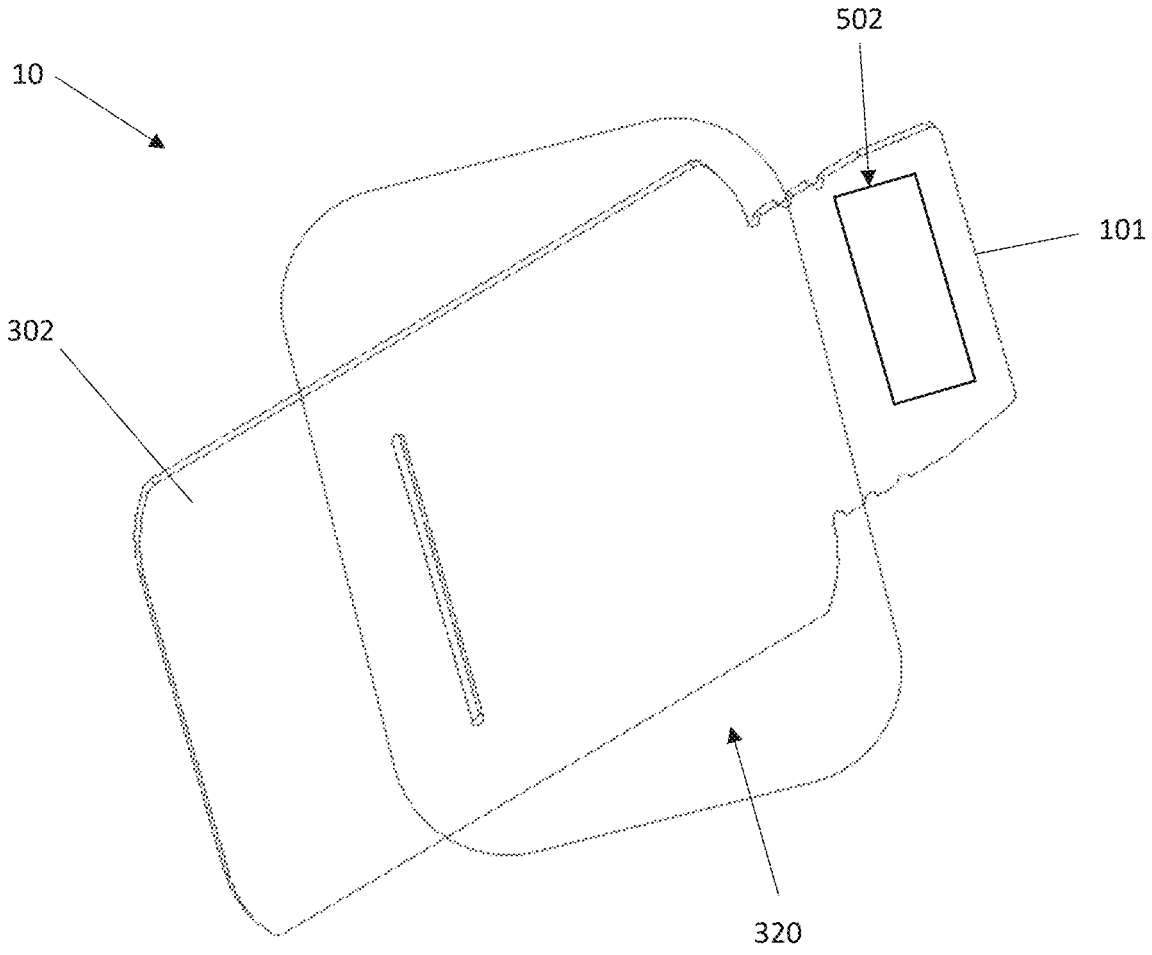
FIG. 11 is a view of the device second side including the alternate fastening system.

Alternatively, other types of fastening mechanisms 500, such as a hook and loop, could be utilized to secure the closure. It is envisioned that a removable fastener could be utilized. Referring now to FIG. 10-11, one alternate fastening mechanism 500 is illustrated, with the flattened planar surface 300 having a first side 301 with a first hook or loop portion 501 generally positioned adjacent to the slot 103 between the slot 103 and the tab 110. A second hook or loop portion 502 is positioned on a second side 302 of the planar surface 300 opposed the first side 301 on the tab 110 generally adjacent to the first end 101. Accordingly, when the device 10 is coiled the first hook and loop portion 501 and the second hook and loop portion 502 are configured to be placed into an adjacent and secured position after the tab 110 is received in the slot 103. This assembly provides a secondary and alternate fastening means and ensures that the device 10 is secured in the coiled position 400.

The second side 302, shown in FIG. 11, may include the coating 320 to reduce friction in the coiled position, wherein the sided and coated assembly of the device 10 ensures ease of use of the device 10. Preferably, this coating 320 is a polymer coating of the nano-ceramic or polytetrafluoroethylene ("PTFE") type, although other similar slick coatings or materials may be used. Accordingly, the device 10 sided assembly ensures that the second side 302 will be more slippery or generally have a coefficient of friction that will be less than a coefficient of friction of the first side 301.

Additionally, a powder substance, such as, but not limited to, talc, may be used on the inside of the cylinder when wrapped to combat the tackiness.

The device 10 material properties provide that it is collapsible (FIG. 9) such that training progressions can go from stickhandling and free movement axially, to the trainee applying pressure to the device 10 to secure the device 10 upon the stick to enable a user a firm grip to pass and or shoot. Upon relaxing the players grip, the device 10 returns to its cylindrical shape 400 and more progressions/repetitions of stickhandling can be done easily.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. An adjustable and flexible device to aid in training for stick-based activities, the device comprising:

a flexible material, the flexible material selected to have recovery properties, wherein the flexible material comprises a planar surface having a first end, a second end opposite the first end, and a slot positioned between the first end and the second end, the slot having a size to receive the first end, wherein the first end is moved to a wrapped position and secured within the slot;

the flexible material configured to be wrapped around a stick through a fastening mechanism, wherein the device is selectively operable between a loosened position and a compressed position.

2. A device as in claim 1, wherein the first end includes a tab and a plurality of notched grooves.

3. A device as in claim 2, wherein the tab and the notched grooves are configured with a size and shape to both conform for receipt within the slot and retain the tab within the slot.

4. A device as in claim 2, wherein the tab, the notched grooves, and the slot are positioned to accommodate a variety of diameters of a shaft size of a stick the device is wrapped around.

5. A device as in claim 1, wherein the flexible material is thin, compressible, and capable of being coiled.

6. A device as in claim 5, wherein the flexible material is selected from the group consisting of rubber, silicone, thermoplastic elastomers (TPE), and leather.

7. An adjustable and flexible device to aid in training for stick-based activities, the device comprising:

a planar surface, the planar surface being a flexible material, the flexible material configured to be wrapped around a stick, wherein the device is selectively operable between a loosened position and a compressed position, the planar surface comprising:

a first end;

a second end, the second end opposite the first end, a distance between the first end and the second end defining a length of the planar surface;

a slot, the slot positioned between the first end and the second end, the slot having a size configured to receive the first end, wherein the first end is capable of being moved to a wrapped position and secured within the slot;

a first side; and a second side, the second side opposed the first side and including a coating, the coating configured to reduce friction, wherein the second side has a coefficient of friction that is less than a coefficient of friction of the first side.

8. A device as in claim 7, wherein the first end includes a tab and a plurality of notched grooves.

9. A device as in claim 8, wherein the tab and the notched grooves are configured with a size and shape to both conform for receipt within the slot and retain the tab within the slot.

10. A device as in claim 9, wherein the tab, the notched grooves, and the slot are positioned to accommodate a variety of diameters of a shaft size of the stick the device is wrapped around.

11. A device as in claim 7, wherein the planar surface flexible material is thin, compressible, and capable of being coiled.

12. A device as in claim 11, wherein the flexible material is selected from the group consisting of rubber, silicone, thermoplastic elastomers (TPE), and leather.

13. A method to enable training of stick-based sports using a device as in claim 1, the method comprising the steps of:

providing the flexible material in a planar surface;

placing the device around a shaft of the stick by wrapping the flexible material upon itself;

forming a cylindrical shape around the shaft of the stick via the fastening mechanism, the cylindrical shape comprising an adjustable internal diameter;

gripping the device loosely during stick handling drills to allow axial rotation of the stick; and gripping the device tightly to prevent axial rotation during shooting and passing drills.

14. A method as in claim 13, wherein the flexible material comprises a first end, a second end opposite the first end, and a slot positioned between the first end and the second end, the slot having a size to receive the first end; wherein the step of forming the cylindrical shape includes moving the first end to a wrapped position and securing the first end within the slot.

15. A method as in claim 14, wherein the first end includes a tab and a plurality of notched grooves.

16. A method as in claim 15, wherein the tab and the notched grooves are configured with a size and shape to both conform for receipt within the slot and retain the tab within the slot.

17. A method as in claim 15, wherein the tab, the notched grooves, and the slot are positioned to accommodate a variety of diameters of shaft sizes of sticks the device is wrapped around.

18. A method as in claim 13, wherein the flexible material is thin, compressible, and capable of being coiled.

19. A method as in claim 18, wherein the flexible material is selected from the group consisting of rubber, silicone, thermoplastic elastomers (TPE), and leather.

* * * * *